United States Patent [19]

Schwarz

[11] Patent Number: 4,774,827

[45] Date of Patent: Oct. 4, 1988

[54] PROCESS OF SPIRALLY WINDING TAPES

[76] Inventor: Walter Schwarz, Lindenbühelweg 12, A-6020 Innsbruck, Austria

[21] Appl. No.: 147,074

[22] Filed: Jan. 20, 1988

Related U.S. Application Data

[63] Continuation of Ser. No. 876,856, filed as PCT AT85/00034, Sep. 26, 1985, published as WO86/02025, Apr. 25, 1986, abandoned.

[30] Foreign Application Priority Data

Sep. 26, 1984 [AT] Austria ..... 3042/84

[51] Int. Cl.[4] ..... B21C 37/12

[52] U.S. Cl. ..... 72/368; 72/50; 72/135

[58] Field of Search ..... 72/49, 50, 135, 137, 72/319, 367, 368

[56] References Cited

U.S. PATENT DOCUMENTS 2,339,219 1/1944 Crowley ..... 72/50

*Primary Examiner*—E. Michael Combs

*Attorney, Agent, or Firm*—Lorusso & Loud

[57] ABSTRACT

A method and a device for the spiral winding of tapes for the continuous production of tubes without a core and having an angular cross-sectional area. A tape is guided centripetally during each bending process along a convexly curved conducting surface situated in the region of the tube being formed, the intake side of which conducting surface is located at the feed level. The centripetal guiding of the tape is suspended when the conducting surface reaches the outlet side for forming the excluding level segment of the tape.

5 Claims, 7 Drawing Sheets

PROCESS OF SPIRALLY WINDING TAPES

Figure 1:
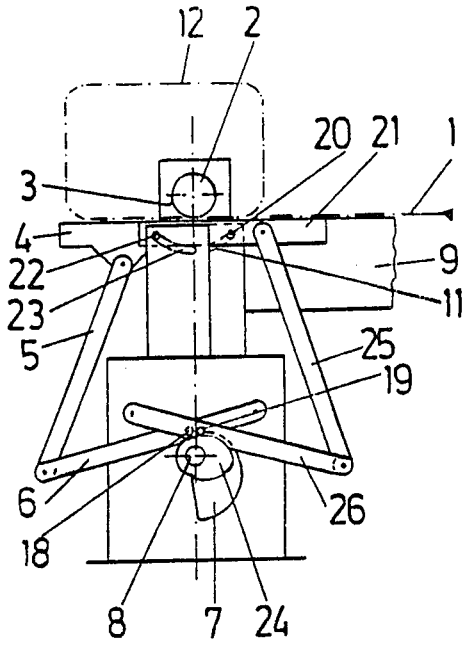
Figure 2:
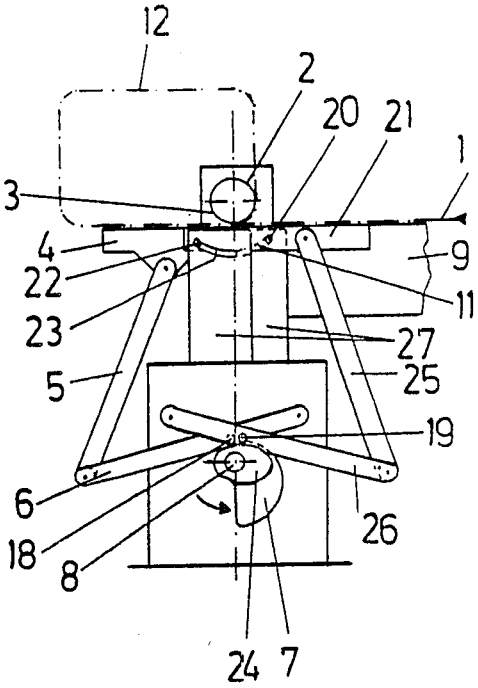
Figure 3:
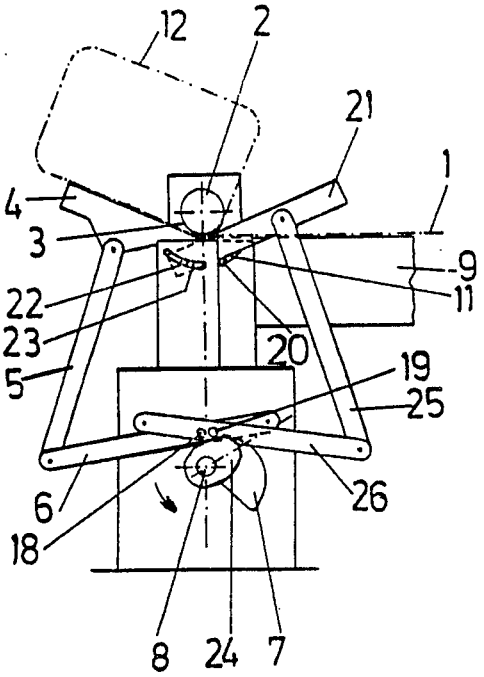
Figure 4:
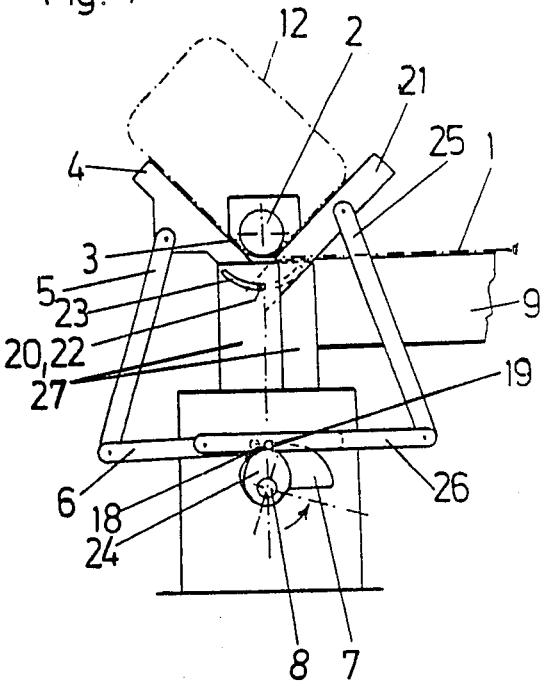
Figure 5:
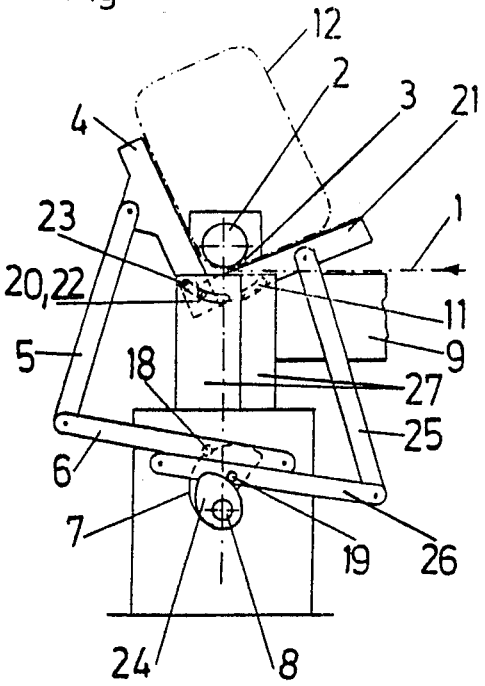

This is a continuation of co-pending application Ser. No. 876,856, filed as PCT AT85/00034, Sep. 26, 1985 published as WO86/02025, Apr. 25, 1986, now abandoned.

FIELD OF THE INVENTION

The present invention relates to a process for the spiral winding of tapes, especially of metal tapes longitudinally grooved at the edge, on tubes having essentially angular cross-sectional areas, whereby the tape being continually advanced is bent off obliquely to the feed direction around each respective interior angle of the cross-sectional area in accordance with a predetermined length of feed, as well as a device with which to carry this out.

PRIOR ART AND ITS DISADVANTAGES

Known in the art are tubes with an angular cross-section, such as are used principally in ventilation channels, and especially those having a rectangular cross-section, which are preferred over round tubes for aesethetic reasons and where space conditions are restricted, although these are considerably more expensive and costly to manufacture.

Thus, for example, in German Pat. No. DE-A-22 28 935 a process is described according to which a metal tape equipped with grooved edges is fed diagonally in cadence into a bending station, is fixed in position by means of a hold-down on the guide table and is edged over the table edge by means of a bending tool situated above the guide table. Following the reverse motion of the bending tool into the starting position the metal tape is advanced by the next length of feed and is then fixed in place and edged off.

A winding process for edged tubes in which the tape is wound around a core are known in the art from American U.S. Pat. Nos. 2,276,285, 2,440,792 and 2,640,451. The use of a core is disadvantageous since a separate core is required for each cross-sectional area and it is necessary to adjust the bending and connecting devices impinging on it.

Tubes with a round cross-section may be wound from relatively narrow tapes of great length drawn off spools around an intended core in spiral form in a continuous operation, so that the tubes will show a given diameter (AT-B-248-839 and 316 283).

According to AT-B-316 283, the winding of folded-seam tubes is accomplished by means of roller pairs which simultaneously close the folded seam. According to AT-B-248 839, the tape is freely bent by means of a number of traverses or strokes of a tool in the close vicinity of an abutment. Non-round tubes can also be produced if periodic alterations are made in the criteria determining the curvature. This process is only applicable to welded-seam tubes since the striking process is not possible for edged grooved borders.

OBJECT OF THE INVENTION

The present invention has the object of finding a process and a device for the continual production without a core of tubes with an angular cross-sectional area, whereby grooved edges can also be provided for the use of metal tape. By an essentially angular cross-sectional area a cross-sectional area is meant bordered by straight lines that fit into one another by means of curves, so that the tubes manifest edge areas that are rounded.

In accordance with the present invention this object is accomplished by guiding the tape centripetally during each bending process along a convexly curved conducting surface situated in the region of the edge of the tube being formed, the intake side of which conducting surface is located at the feed level, whereby the centripetal guiding of the tape is in turn suspended when the conducting surface reaches the outlet side for forming the excluding level segment of the tape.

The process in accordance with the present invention thus represents a continual winding process not dependent on the formation of the seam. Angular tubes with rounded-off edges of any desired length may be produced without interrupting the tape feed and while retaining the guide, even during the bending process, whereby tubes with any convex cross-sectional area and any given number of angles may be manufactured by virtue of the choice of the length of curve and of the length of the flat segments.

A preferred embodiment for carrying out the process in accordance with the present invention has a guide table for the incoming tape, a supporting element in the region of the edge of the tube being formed, a bending tool which can be moved around an axis parallel to the contact surface of the guide table, and a mechanism with spools for the continuing connection between the incoming tape with the advancing winding of the tube and is characterized by the fact that the supporting element is formed by a bar extending above the guide at an interval corresponding to the thickness of the tape over at least two windings of the tube, which bar is equipped at the least in its lower half facing the guide table with a convexly curved contact surface, and that the bending tool is formed by a level bending plate inserted into the guide table, the upper side of which bending plate guiding the tape during the bending process rolls from the contact level crossing upward on the conducting surface, drops downward at the end of the bending process around a fixed axis on the table away from the conducting surface and into the contact surface and finally moves back into the starting position.

The tape feeding into the aperture between the bar and the contact level of the guide table is advanced on the guide table, with account taken of the angle between the direction of intake and the longitudinal direction of the bar, by the extent of the desired length of side of the cross-sectional area and the tube being produced, less double the portion of the curves, following which the bending plate turns up from the contact level. In so doing, the continually advancing metal tape is guided centripetally on the conducting surface of the bar and bent to match. As soon as the the curve length corresponding to the desired interior angle between the two lateral surfaces of the emerging tube is reached, an axial interlocking is accomplished between the bending plate, which turns around the axis of the conducting surface during the bending process, and the guide table. The bending plate is closed down into the guide table around the resulting axis fixed on the table. This axis fixed on the table arises opposite the incoming tape in relation to the aperture between the bar and the guide table, so that the upper side of the bending plate pulls up in the shutting motion from the tape being guided on the conducting surface and does not impede the continued further advancing of the tape, whereby the side wall part, which has just been bent upward, of the emerging tube is shunted along. During the advancing of the next segment corrsponding to a second side of the cross-sectional area the bending plate reverts to its starting position after the axial interlocking has been disengaged. Thus the next bending procedure can be introduced. The upper side of the level bending plate, which, in order to guide centripetally, always turns parallel to a tangential level of the conducting surface during the bending process, in a further embodiment is capable of being moved in a guide of the guide table parallel to the conducting surface which is also convexly curved. A preferred embodiment makes provision for the bending plate to have at least one trunnion which engages in a guide aperture running parallel to the conducting surface of the bar and which can be stopped in in the final bending position when the axis fixed on the table is formed, whereby at least one controlled activating lever is hinged on the bending plate. A sequence-switch cam has been provided for the motion of the activating lever especially, the drive of which is coordinated with the advance of the tape.

An additional preferred embodiment provides for the roll-off speed of the upper side of the bending plate in the shifting motion to be the same as the advancing speed of the tape, so that practically no relative motion occurs between the tape and the bending plate and that as fast a tilting motion of the bending plate as possible will occur at the end of the bending procedure. This can be accomplished by an appropriate designing of the sequence-switch cam, by coupling and uncoupling the control drive, and if necessary by means of a step-up in the transmission via an additional activating lever.

To bring about the axis fired on the table by means of an axial interlocking of the trunnion a spring-loaded stop lever will preferably be used which comes to rest on the trunnion when the bending procedure is concluded, whereby a disengaging extension is provided for on the stop lever to act on the bending plate dropping down at the end of the retro-closing movement. As soon as the upper side of the bending plate is aligned with the contact surface of the guide table, the trunnion is thus set loose and the axial interlocking disengaged, whereupon the bending plate will return to the starting position, preferably by means of a restoring spring. Thus in a preferred embodiment a guide stretch in a straight line is formed for leading back into the starting position and this connects the ends of the convex guide. The switching operation is thus accomplished for leading back in a straight line by means of a depressed stop lever, which when connecting to its detent shows a segment aligned with the restoring movement in a straight line and bridging the convex guide movement.

The mechanism equipped with a locking or welded roller pair for connecting the longitudinal tape edges by winding the tube can in itself be located in any place desired. It will be advantageous to install it at the narrowest point of the aperture between the bar facing the conducting surface and the guide table or the bending plate impinging into this region since no change of location for the roller pair is necessary there. For this purpose it is provided in one embodiment for the bar to be cylindrical and hollow and for the inner connecting roll to be parallel to the feeding device in relation to the tube to be formed. Since in general it is necessary for it to have a drive, it is mounted on a shaft which extends diagonally into the hollow cylindrical bar. In the area closest to the guide table, thus at the narrowest site of the aperture a pass-through slot is provided for the inner connecting roller, through which it makes contact with the tape edges to be connected. The outer counter-roller is mounted in the guide table.

During the blending process the tube under formation is moved upward by the bending plate. For tubes of a fairly large cross-sectional area it will be advantageous to make provision for an opposing support from the point of exceeding the unstable point of equilibrium, on which support the tube can rest until the bending process is completed. Thus in a further embodiment a support place is situated just opposite the bending plate, which support plate is also guided centripetally in the conducting surface. At the beginning of the bending process the support plate located in the guide table and which is displaced opposite the bending plate in the longitudinal direction of the tube by at least the width of the incoming tape is also moved upward and directly returns to its starting position again when the tube being formed is taken over. Since the sequence of movements is similar to that of the bending plate, the control of it can also be accomplished in a similar manner, for which purpose at least one activating lever and a sequence-switch cam have in turn been provided by preference. If cam disks are provided for as sequence-switch cams, these should preferably be installed each to an intermediate lever hinged to the activating lever. Provision is made through a further possibility for one arm extending radially from the drive shaft each to be provided for as cam sterring, on the free end of which a tang has been provided, and for a stop groove to be provided on the free end of each activating lever in which the tang reaches via an angular area of its backward motion.

Preferably both sequence-switch cams will be arranged on the same drive shaft, the rotation of which, as mentionedl, is coordinated with the advance of the tape.

For the production of long pieces of tube it is recommended to have an additional support device for the tube, each to consist of a plate pair that can be moved to be synchronous with the bending plate and the supporting plate, and is arranged in a fixed position to them.

In the following the present invention will be described with reference to the figures of the attached drawings in closer detail, but without being limited to them.

Figure 7:
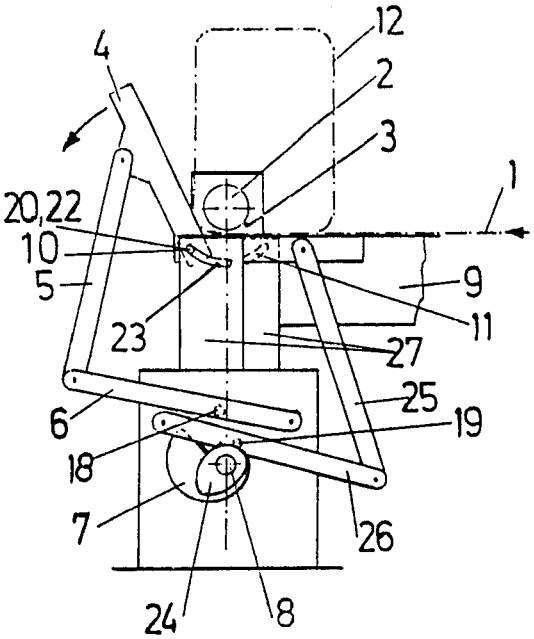
Figure 8:
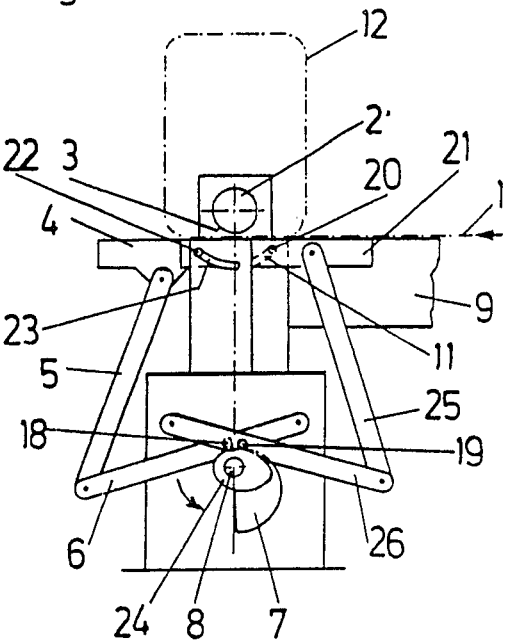
Figure 9:
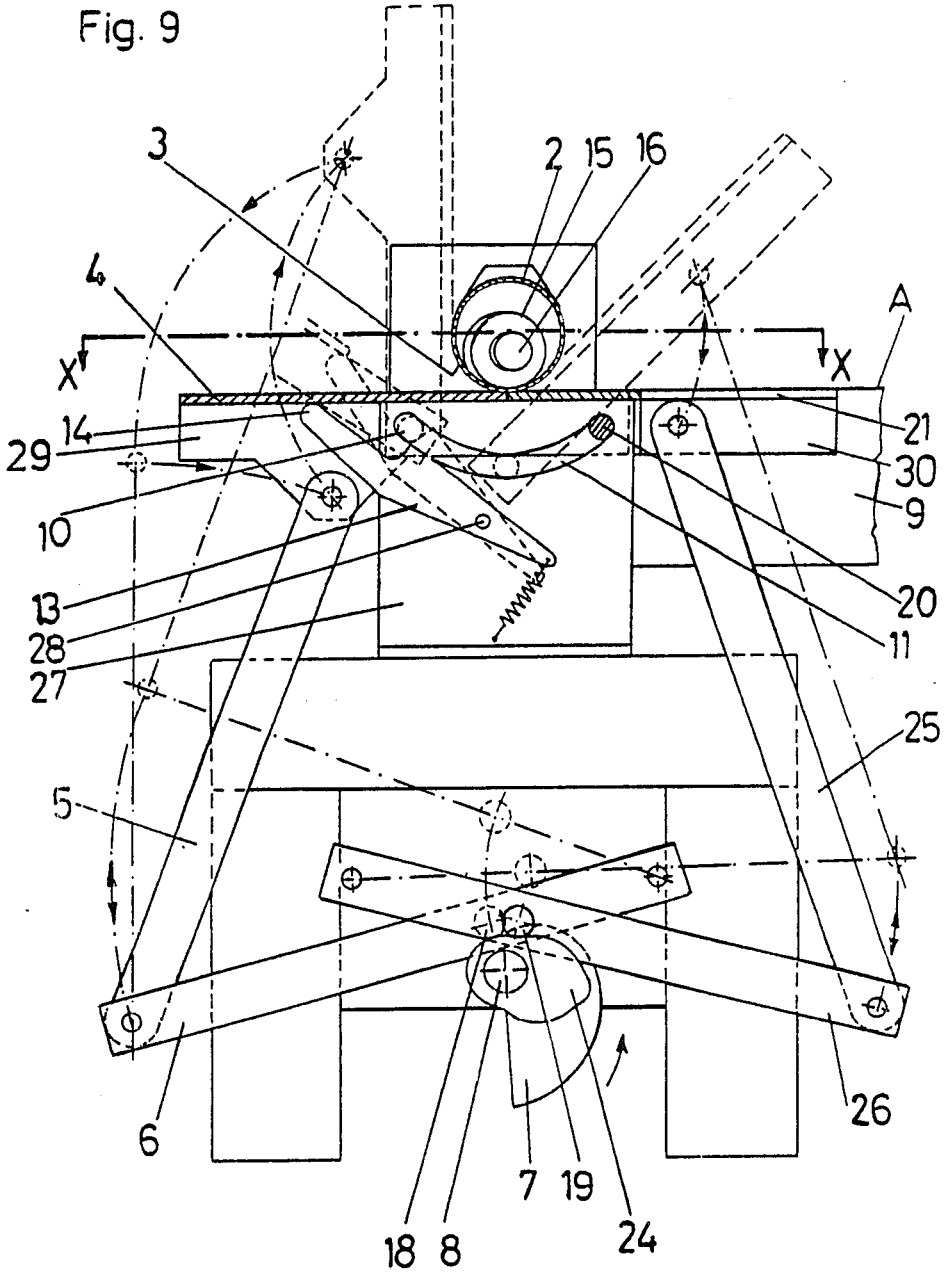
Figure 10:
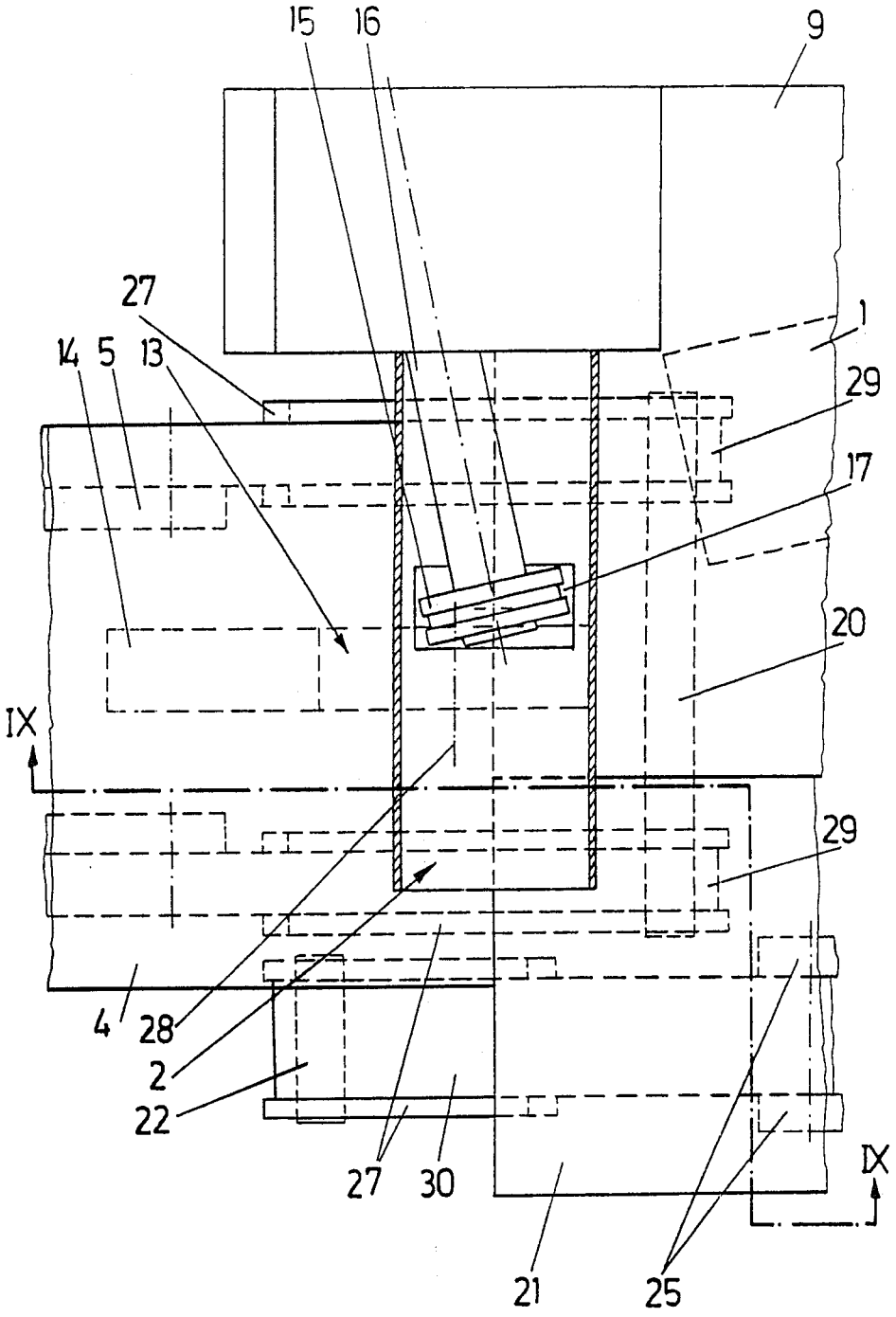
Figure 11:
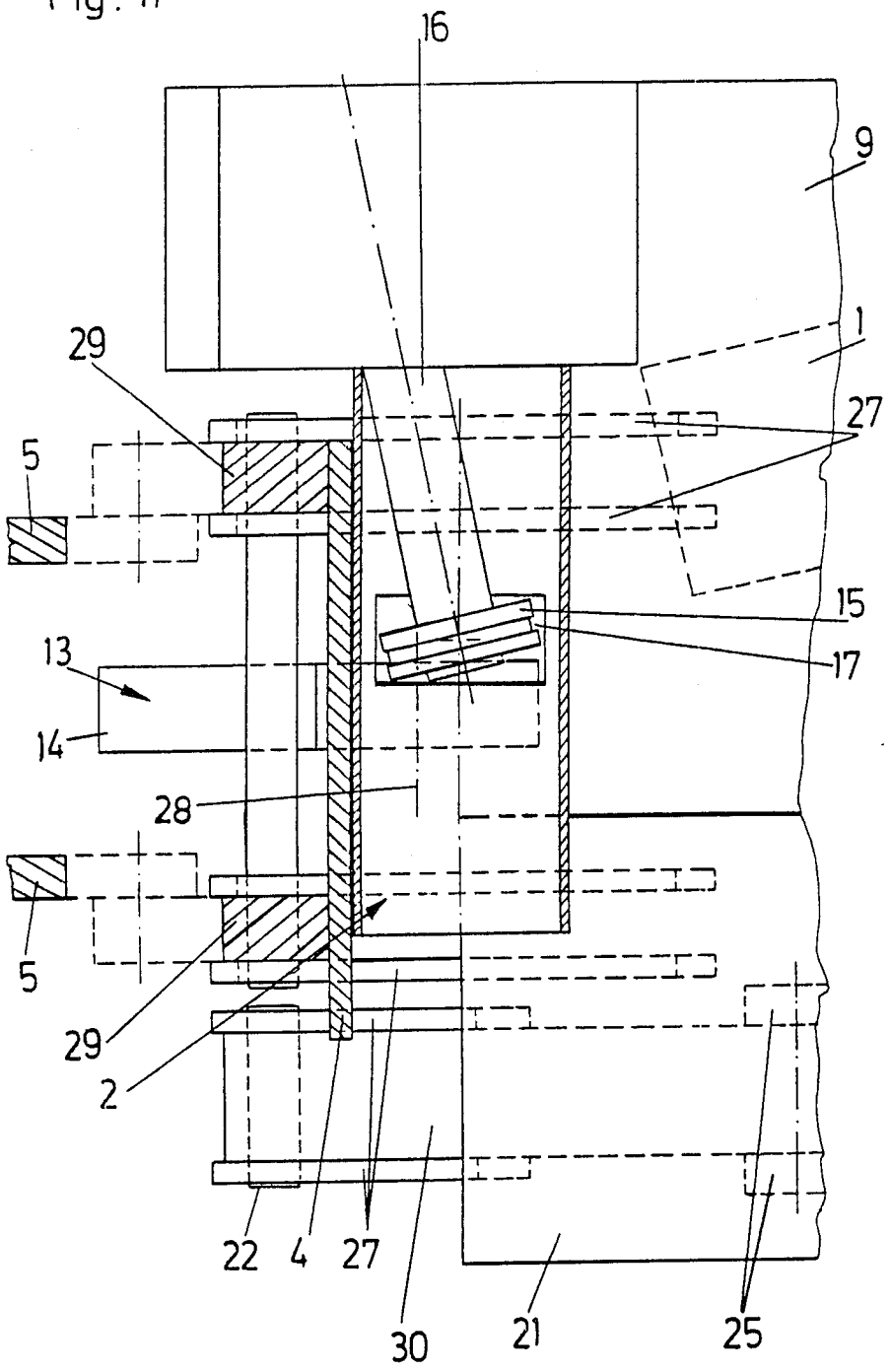

FIGS. 1–8 show the sequence of movements during a bending process by means of a preferred embodiment of a device in accordance with the present invention in winding a square tube with an essentially rectangular cross-sectional area; FIG. 9 shows a vertical section of the preferred embodiment of the device in accordance with the present invention according to the IX—IX of FIG. 10; FIG. 10 shows a horizontal section according to the Line X—X in FIG. 9; FIG. 11 shows a section according to FIG. 10 with an upward-turned bending plate; and FIGS. 12–17 show the sequence of movements during one bending procedure by illustration of a second embodiment of a device in accordance with the present invention.

The process illustrated in the sequence of motions in FIGS. 1–8 can be accomplished, for example, with a device in accordance with FIGS. 9 through 11. On a stand for the device a guide table 9 and a number of vertically situated plate-shaped supports 27 have been provided. Above the table level A a support element in the form of a hollow cylindrical bar 2 extends while retaining an aperture to the table level A corresponding to the thickness of the tape 1 to be wound and and located in the longitudinal direction of the tube 12 to be wound (FIGS. 1 through 8), which support element has a length which encompasses at least two, but preferably three or four windings of the tube 12. Below the hollow cylindrical bar 2 a sluable bending plate 4 is situated in the guide table 9 in the region of the incoming tape 1, the length of which bending plate 4 is approximately that of the bar 2. The upper side of the bending plate 4 lies at the table level A and two strips 29 extending in the longitudinal direction of the tube 12 being wound are located on the underside of the bending plate 4. The bending plate extends, beginning at a vertical axial level through the hollow cylindrical bar 2 on to the side of the incoming tape 1 opposite in relation to the bar 2. The half of the casing of the hollow cylindrical bar 2 pointing downward forms a convexly curved conducting surface 3, along which the incoming tape 1 can be bent with the aid of the bending plate 4. The inlet side of the conducting surface 3 for bending the tape 1 is situated in the vertical axial level through the hollow cylindrical tube 2, thus an the narrowest point of the aperture between the bar 2 and the table level A, and the outlet side correspondingly shifts in accordance with the interior angle to be bent by the appropriate circular measure. The bending plate 4 is guided at the time of the sluing motion from table level A upward one the one hand in circular guide slots 11 in the plate-shaped supports 27 through a trunnion 20 protruding laterally from the strips 29, whereby in lieu of the penetrating trunnions 20 as shown in the illustrations trunnions only slightly overhanging the strips 29 can be provided, and on the other hand moves via activating levers 5 hinged to the strips 29. The predominant direction of motion of the activating lever runs approximately vertically upward, whereby the upper side of the bending plate 4 (with, of course the tape 1 to be moved in the intermediate position) rolls off one the conducting surface 3 and in so doing traverses all tangential levels to the conducting surface 3 between the starting position shown in complete lines in FIG. 9 and the final bending position shown in dash lines for a 90-degree bending angle. The movement of the bending plate 4 thus represents a revolution around the axis of the hollow cylindrical bar 2, whereby it is continuously pressed centripetally to the conducting surface 3. Since the sluing speed of the bending plate 4 will preferably be coordinated with the feed-in speed of the continually incoming tape 1, there will only be a slightly relative motion between the tape undergoing bending and the bending plate, and this may only be attributed to the oblique input angle of the tape.

Just opposite the bending plate, thus on the inlet side of the bar 2, a support plate 21 has been provided which is displaced in the longitudinal direction against the bending plate 4.

The support plate 21, which is also sluable upward from the table level A, serves the purpose of assuming the segment of tube just produced during each bending procedure when the unstable position of equilibrium has been exceeded and of supporting it relevant to the further tilting through the bending plate 4 moving upward into the final bending position to the return to contact on the table level A. The supporting plate 21 is formed essentially symmetrical for this purpose and arranged thus, i.e. it has at least one strip 30 on its lower side, from which on either side a trunnion 22 protrudes, which trunnion can be shifted in circular guide slots 23 of additional plate-shaped supports 27. The upper side of this support plate 21 rolls during the shifting in the conducting surface 3 as well (and, of course, also on the outer side of already produced tube windings that are being centripetally guided during this procedure), whereby at least one activating 25 is hinged to the strip(s) 30 of the support plate 21.

The sequence of movements of the bending plate 4 and the support plate 21 is controlled by a cam operation. According to FIGS. 1–9, two cam disks 7, 24 are arranged on a drive drive 8 in the preferred embodiment, and along their controlling curves rollers 18, 19 fixed on each intermediate lever 6, 26 roll during rotation. The intermediate lever 6 is hinged to the activating lever 5 of the bending plate and the intermediate lever 26 is hinged to the activating lever 25 of the support plate 21. The control curves of the two cam disks 7, 24 are differently shaped.

According to the FIGS. 12 through 17 showing additional embodiments, the control of the activating lever 5, 25 is not performed by cam disks. In lieu of these, arms 31, 32 protruding radially from the drive shaft 8 are employed that have tangs 33, 34 on the end. In the course of rotation these are aligned via angle areas to stop grooves 35, 36 provided at the ends of the activating levers 5, 25. The drive shaft 8 of the two arms 31, 32 situated diametrically opposite one another can be connected to the main drive via a magneto coupling, for example.

A disk is also attached to the drive shaft 8, on the circumference of which a notch 37 is formed to define the rest positon. A stop lever acted on by an initial compressed air cylinder 42 engages in the notch 37. A second compressed air cylinder 43 bears a ram 39 for putting the activating lever 5 into action. Two additional compressed air cylinders 44, 45 are assigned to the activating lever 25 and these move the rams 40, 41, whereby the ram 41 is provided for coming to rest on a projection 46, which stands out from the free end of the activating lever 25 toward the outside. In addition, a restoring spring 47, shown only schematically, between the frame of the device and the activating lever 25 has been supplied, whereby a detent (not shown) lies in the restoring path of the activating lever 25.

Figure 6:
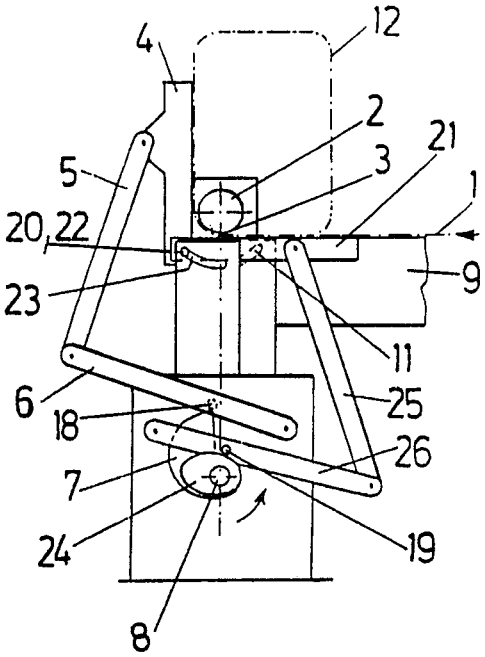

The process will be explained in greater detail for manufacturing tubes 12, with reference to FIGS. 1 through 8. FIG. 1 shows at least one winding of the tube 12. The tape 1, in each of the illustrations as seen on the right, on the guide table 9 into the mechanism. According to FIGS. 1 and 2, the portion of the tube 12 already produced pushed on unimpeded to the left, whereby the bending plate 4 and the support plate 21 are lowered in the guide table 9. According to the relevant length the lower, rounded edge region of the tube 12 (at right in the drawing) applies itself to the right half of the conducting surface 3 of the bar 2. Since the feed of the tape 1 is not interrupted, the portion of the tube already produced must turn upward (FIGS. 3–6), whereby the bending plate 4 turns upward via the cam control and the tape 1 is guided centripetally around the bar along the left half of the conducting surface 3, so that any deformation of the tube will be prevented and the tape 1 is bent exactly. As will be seen in FIGS. 3 and 4, the support plate 21 also shifts simultaneously with the bending plate 4, and it is shifted upward, as mentioned, from the guide table 9 and rests against the tube 12. Thus the turning point of the shifting movement of the support plate 21 is reached, which, controlled via the cam disk 24 and the two activating levers 26, 26, again moves downward into the guide table 9, whereby it (FIG. 5) supports the tube 12 when it exceeds the unstable point of equilibrium while the bending plate 4 is once more raised upward until the conclusion of the bending process (FIG. 6). The trunnions 20, 22 of the bending plate 4 and the support plate 21 move in the guide slots 11 and 23, whereby the arc length of the guide slot 23 for the support plate 21 is shorter than the guide slot 11 for the bending plate 4. As soon as the final bending position in accordance with FIG. 6 has been attained, the trunnion 20 is fixed in place, through which means an axis 10 fixed to the table is formed (FIGS. 7, 9). This is accomplished by means of a stop lever 13 activated by a sping (FIGS. 9, 11), which lever can be slued below the bending plate 4 around an axis 28 and which has a stop catch, which comes to rest on the trunnion 20 when the final bending position is reached. The cam disk 7 has a slightly radially declining concluding flank, so that the activating lever 6 can drop directly downward, whereby the bending plate 4 revolves around the axis 10 fixed to the table. The bending place 4 thus lifts up very swiftly, precisely with a speed corresponding to that of at least the infeed speed of the tape, and laterally from the conducting surface 3 as well as the tape bending upward, by means of which, owing to the rounded edge region thus, the continuous advance of the tape is not obstructed (FIG. 8). The cam disks 7, 24 rotate back into the starting position and are not put into motion again until the beginning of the next bending sequence.

The stop lever 13 has a disengaging extension 14, which is activated by the lowering bending plate 4 in the final portion of the path of movement. The stop lever 13 is accordingly depressed downward and frees the trunnion 20 again, by which means the axis 10 fixed to the table is once more removed. The bending plate 4 shifted back into the guide table 9 can return to starting position during the further advance of the tape 1, for which purpose restoring mechanisms (not shown in the drawing) serve.

In order to be able to wind longer tubes 12 at least one pair of plates has been provided at the end of the tube, both of which are installed and controlled in the same manner and which pair moves along with the tube in the longitudinal direction, whereby here in lieu of the bending plate 4 a second support plate is provided to carry out this function.

Figure 12:
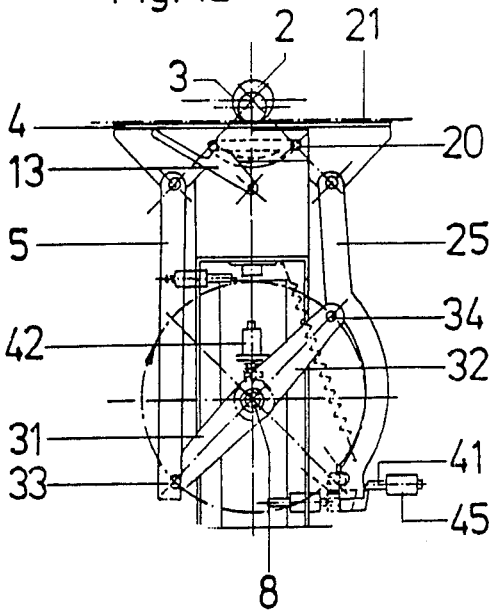
Figure 13:
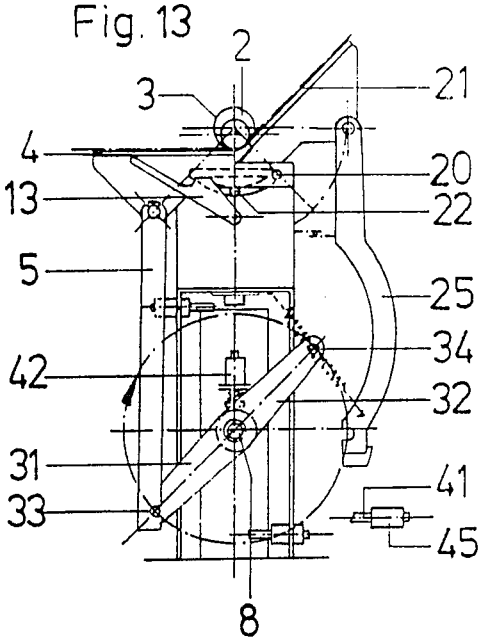
Figure 14:
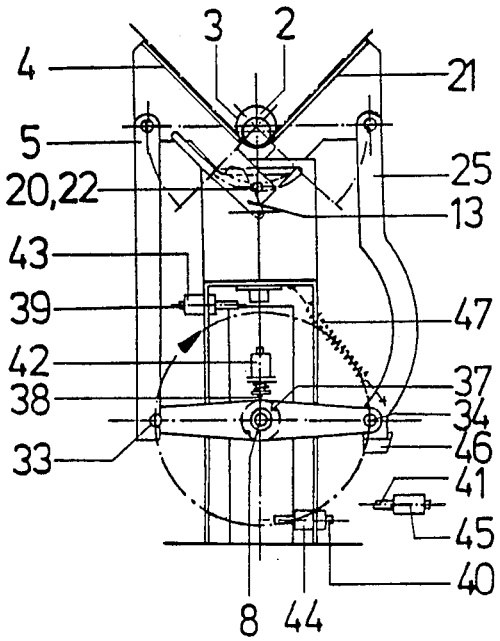
Figure 15:
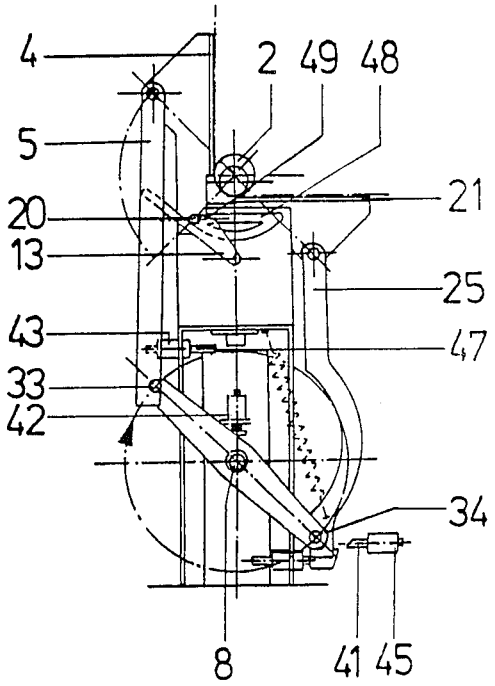
Figure 17:
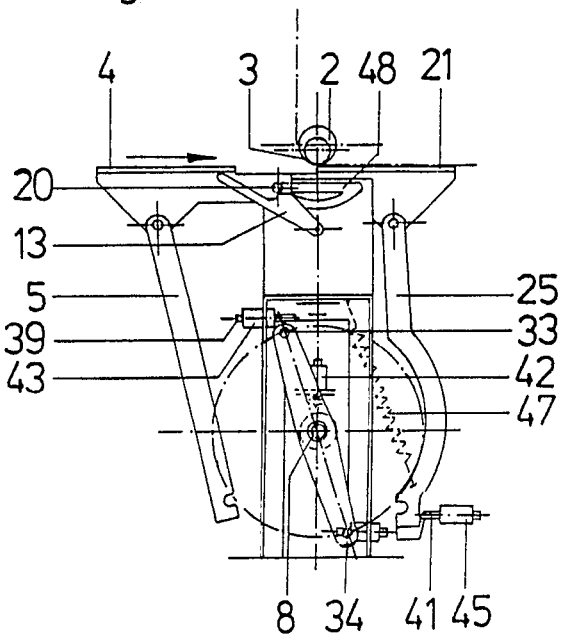

According to the device illustrated in FIGS. 12 through 17 the activating levers 5, 25 are controlled in the following manner:

The bending procedure is started up from the rest position shown in FIG. 12 by an electrical impulse. This activates the magneto coupling mentioned of the drive shaft 8 and the two compressed air cylinders 42 and 45. The drive shaft 8 is connected to the main drive via the magneto coupling by the way of a countershaft, whereby a choice of gear ratios for the speed of rotation of the drive shaft 8 allows for adaptation to the infeed speed of the tape 1. The stop ram 38 of the compressed air cylinder 42 is withdrawn from the notch 38 and sets the revolving arms 31, 32 mounted on the drive shaft 8 into motion. Activation of the compressed air cylinder 45 pulls in the ram 41 lodged on the projection 46, so that the activating lever 25 under the effect of the spring 47 is pulled up into the position shown in FIG. 13, so that the support plate 21 is turned by 45 degrees into the starting position. The tang 35 [sic] of the first arm 31 in rest position (FIG. 12) reaches into the stop groove 35 of the activating lever 5. The beginning rotation of the arms 31, 32 now effects the return motion of the revolving process since the bending plate 4 is shifted upward by the activating lever 5. In the intermediate position shown in FIG. 14 the two arms 31, 32 extend horizontally and the bending plate 4 has been moved upward by 45 degrees, so that this together with the support plate 21 form a right angle. The detent for the activating lever 25 of the support plate 21 is arranged in such an manner that the stop groove 36 of the activating lever 25 is situated at the level of the drive shaft 8, so that in the intermediate position as shown in FIG. 14 the tang 34 of the arm 32 clicks into the stop groove 36. At the time of rotation into the position as depicted in FIG. 15 the two activating levers 5, 25 are positively guided by the arms 31, 32, so that the bending plate 4 is shifted further upwards and the support plate 21, which is increasingly assuming the weight of the tube under construction, shuts back to the table level. The bending process is completed in the position according to FIG. 15, whereby the stop lever 13 interlocks the trunnion in the axis 10. In this position the compressed air cylinder 43 is activated, the ram of which 39 deflects the activating lever 5 so far to the side that the tang 33 moves out of the stop groove 35; through which means the connection with the arm 31 is disengaged. Through this means the bending plate 4 drops or flaps back around the axis 10 into the table level, so that the continued advance of the tape is not impeded. At the same time, however, the compressed air cylinders 44 and 45 are activated, so that the ram 41 of the cylinder 45 is moved back into the catch position and the activating lever 25 is deflected by the ram 40 of the cylinder 44. At the same time the projection 46 is lodged on the ram 41 of the cylinder 45 and the tang 34 slides out of the stop groove 36, by which means the support plate 21 is retained at the table level. The rams 39 and 40 are again restored during the further rotation of the arms 31, 32 (FIG. 17). As soon as the notch 37 has once more come into the starting or rest position according to FIG. 12, the stop ram 38 engages in it while the drive shaft 8 is uncoupled. The cam steering is thus finished for this bending sequence.

Figure 16:
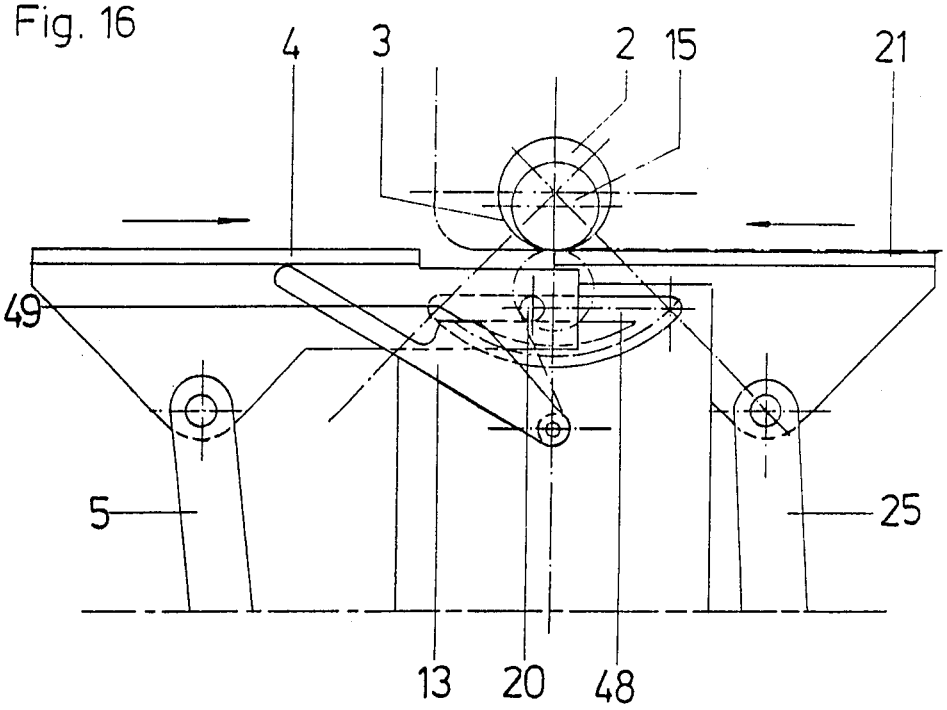

During the remainder of the rotation of the arms 31, 32 into the rest position (FIG. 15, FIG. 17, FIG. 12) the restoration of the bending plate 4 to table level takes place, whereby FIG. 16 shows an intermediate position in detail that can be assigned roughly to follow the intermediate position shown in FIG. 17 of the cam steering. The guide slot 11 for the trunnion 20 has a straight-line return stretch 48, so that the bending plate 4 is brought back into the starting position in a horizontal motion by the pull-back mechanism. For this purpose the beginning of the convex guide slot 11 must be bridged. The stop lever 13 for this purpose has a segment 49 connecting to its detent, which segment aligns with the straight line return stretch 48 in the close-back position of the bending plate 4, through which means this part exclusively of the guide slot 11 is free. When the bending plate 4 shifts upwards, the spring-loaded stop lever 13 switches downward, so that the shifting motion of the bending plate 4 is not obstructed.

The connecting device which connects the incoming tape 1 to the last winding of the tube is in itself not a component of the present invention and can, for example comprise a pair of folding rollers, of which one closing roller 15 is provided in the interior of the emerging tube 12 and the other on the outside. The connection or fold-closing is accomplished in an especially simple manner at the single location that does not shift relative to the guide table and through which the tube runs during winding, viz. in the vertical axial level of the bar 2, thus at the narrowest point of the through-put aperture.

The inner closing roller 15 is situated on axis jutting diagonally into the hollow cylindrical bar 2 or situated on a driven shaft 16 likewise positioned, whereby within the conducting surface 2 a penetration aperture 17 has been provided in the wall of the bar 2 (FIGS. 10, 11), so that the closing roller 15 is in direct contact with the connecting area between the tape 1 and the winding of the tube 12. The counter roller on the outside is situated in the guide table 9 below the closing roller 15, but has not been depicted for reasons of clarity in viewing. Since the infeed angle of the tape 1 must be altered, depending on the width of the tape 1 and the size of the tube 12 to be produced, the closing roller 15 and the counter roller opposite it are sluable around the imagined vertical axis extending through the axis of the bar 2 and the midpoint of the two connecting rollers. In FIGS. 10 and 11 the maximum angle of traverse is depicted, respectively, between the shaft 16 and the bar 2.

If the tube windings are connecting by a fold as is made possible by the closing roller 15 illustrated, the bending plate 4 and the support place 21 will have indentations (not shown) into which the grooved edges of the tape 1 and the grooves between the windings impinge, so that the bending plate 4 and the support plate 21 have contact over the entire width of each winding and it is possible to guide the material with precision along the conducting surface. As mentioned, welding rollers can also be installed with which to weld the material.

The process in accordance with the present invention is suitable for the production of continuously wound tubes having essentially rectangular cross-sectional areas since both the interior angle to be bent and the length of the side can be selected.

What we claim is:

1. A method for the continual spiral winding of tape into a tube without a core and with an essentially angular cross-sectional profile, comprising the steps of:

(1) continually advancing said tape along a conducting surface which is convexly curved at a predeterminable angle and which is situated in the region of said tube being formed, said conducting surface having an input side through which said continually advancing tape is fed and an opposed output side, separated from each other by a predeterminable feed length;

(2) guiding said continually advancing tape centripetally along the axis of curvature of said conducting surface as said tape advances from said inlet side to said outlet side;

(3) applying to said tape and said conducting surface a bending force radially along the axis of curvature of said conducting surface simultaneously with said tape being centripetally guided along said conducting surface, whereby said tape is bent diagonally to the direction of feed of the tape to match said predeterminable angle of said conducting surface;

(4) suspending said guiding of and the application of said bending force to said continually advancing tape as said tape exits said output side, whereby the unbent portion of said continually advancing tape maintains its original shape for a predeterminable feed length; and (5) repeating steps 1–4 to said continually advancing tape.

2. The method of claim 1 wherein said tape is metal.

3. The method of claim 1 wherein said tape is essentially flat as said tape is initially fed into said input side of said conducting surface.

4. The method of claim 1 wherein said tape has grooved edges.

5. The method of claim 1 wherein said predeterminable angle is one interior angle, respectively, of said cross-sectional profile.

* * * * *